United States Patent [19]

Olson

[11] 4,000,002

[45] Dec. 28, 1976

[54] METHOD AND APPARATUS FOR CLEANING CONTAINERS WITH PROTECTIVE FOGGING

[75] Inventor: Ralph J. Olson, Glenside, Pa.

[73] Assignee: Crown Cork & Seal Company, Inc., Philadelphia, Pa.

[22] Filed: Mar. 7, 1975

[21] Appl. No.: 556,396

[52] U.S. Cl. ..... 134/25 R; 134/23; 134/26; 134/29; 134/30; 134/48; 134/50; 134/55; 134/102; 134/152; 134/171

[51] Int. Cl.[2] ..... B08B 3/02

[58] Field of Search ..... 134/25 R, 21, 37, 15, 134/29, 30, 68, 72, 129, 32, 102, 48, 50, 54, 55, 152, 171, 23, 26

[56] References Cited

UNITED STATES PATENTS

| | | | |
|---|---|---|---|
| 1,276,659 | 8/1918 | Jensen | 134/30 |
| 2,650,178 | 8/1953 | Martin et al. | 134/30 X |
| 2,710,819 | 6/1955 | Weber et al. | 134/30 X |
| 3,266,934 | 8/1966 | Alexander | 134/30 X |
| 3,442,708 | 5/1969 | Huddle | 134/26 R X |

*Primary Examiner*—S. Leon Bashore
*Assistant Examiner*—Marc L. Caroff
*Attorney, Agent, or Firm*—Woodcock Washburn Kurtz & Mackiewicz

[57] ABSTRACT

A container washing system comprises a container washing zone, a rinsing zone and a deionized rinsing zone through which containers are conveyed. At each of the zones, spray nozzles direct washing and rinsing liquids at the containers. In order to prevent the etching of stationary containers when the conveyor is interrupted, the spray nozzles in the washing and deionized rinsing zones are deactivated. In order to prevent the oxidation or rusting of the stationary containers in the absence of the washing and deionized rinsing liquids, the containers are maintained in the moist condition by fogging nozzles located within the washing and deionized rinsing zones.

17 Claims, 2 Drawing Figures

METHOD AND APPARATUS FOR CLEANING CONTAINERS WITH PROTECTIVE FOGGING

BACKGROUND OF THE INVENTION

This invention relates to the washing of containers and cans in large quantities. This invention particularly relates to a method and apparatus which may be utilized in a container or can production line to remove foreign matter from the containers or cans incident to the production thereof.

In the manufacture of cans, it may be desirable to provide a can washing system in the can production line which is capable of handling very large quantities of cans. In a so-called D&I (drawn and ironed) can line, large gaps in the flow of cans will oftentimes occur as when the conveying system of the entire can line is stopped for any of a variety of reasons. Typically, a washing system utilized in such a can line comprises a plurality of washing and rinsing zones including an alkaline washing zone and a deionized water rinsing zone. When the cans stop in the washing system due to the interruption in flow of the cans through the can line, the alkaline washing liquid in the washing zone and the deionized rinsing liquid in one of the rinsing zones are directed at the same cans for an extended period of time. Due to the strength and nature of the alkaline washing liquid and the deionized rinsing liquid, the spraying of the cans with these liquids can result in an etching of the cans. Where the cans comprise tinplate, cans can actually be detinned by the action of the alkaline washing liquid and the deionized rinsing liquid.

In order to eliminate this etching or detinning effect caused by extended periods of contact between the cans and the alkaline washing liquid spray and the deionized rinsing liquid spray, the cans have been conveyed on through the washing system even though the rest of the can line has been stopped. This creates large gaps or voids in the production line which are undesirable in that they create delays once the can line is back in operation. In addition, an accumulating capacity must be provided at the output of the washer system which may in itself be expensive.

In order to prevent the etching or detinning of the cans while at the same time avoiding the large gaps or voids in the can production line, the washing system could be closed down with the rest of the line so that the spray of alkaline washing liquid and the spray of deionized rinsing liquid would not be directed at and make contact with the cans within the washer system. However, this would allow the cans to air dry while they remain in the washer system. Such drying is undesirable since it produces oxidation or rusting of the cans.

SUMMARY OF THE INVENTION

It is therefore an object of this invention to provide a method of and apparatus for washing containers which may be interrupted or stopped without risk of oxidation or rusting of the containers.

It is a more specific object of this invention to provide a method of and apparatus for washing containers that may be stopped or interrupted so as to avoid the etching or detinning of the containers while at the same time preventing oxidation or rusting thereof.

In accordance with these and other objects of the invention, containers are conveyed through a washing and rinsing zone while being sprayed respectively with washing and rinsing liquids. When the conveying of the containers through the washing and rinsing zone is interrupted, spraying of the containers with the washing liquid is also interrupted. Upon interruption of the spraying of the containers with the washing liquid, a fog is created within the washing zone so as to substantially retard the oxidation of the containers.

In a preferred embodiment of the invention, the washing liquid comprises an alkaline cleaner liquid which tends to be destructive to a stationary container within the washing zone. The rinsing liquid comprises neutral, substantially harmless liquid such as water so as not to require the interruption of the rinsing liquid spray and the creation of a fog in the rinsing zone.

In further accordance with the invention, the containers are conveyed through a deionized rinsing zone in which a deionized rinsing liquid sprays the containers. The spraying of the deionized rinsing liquid is also interrupted when the conveying of the containers through the deionized rinsing zone is interrupted while a fog is created within the deionized rinsing zone so as to substantially retard the oxidation of the containers.

In further accordance with this invention, blow-off areas are provided between the washing zone and the rinsing zone and between the rinsing zone and the deionized rinsing zone respectively. The blow-off, which is preferably provided by steam, is interrupted when the conveying of the containers through the blow-off areas is interrupted and a fog is created in the blow-off areas so as to also retard the oxidation of the containers in the area.

In the preferred embodiment of the invention, the liquid which creates the fog in the washing zone is preheated to a temperature substantially equal to the temperature of the washing liquid. However, the liquid which forms the fog in the deionized rinsing zone comprises a rinsing liquid which is maintained at substantially the same temperature as the deionized liquid spray.

DETAILED DESCRIPTION OF A PREFERRED EMBODIMENT

Figure 1:
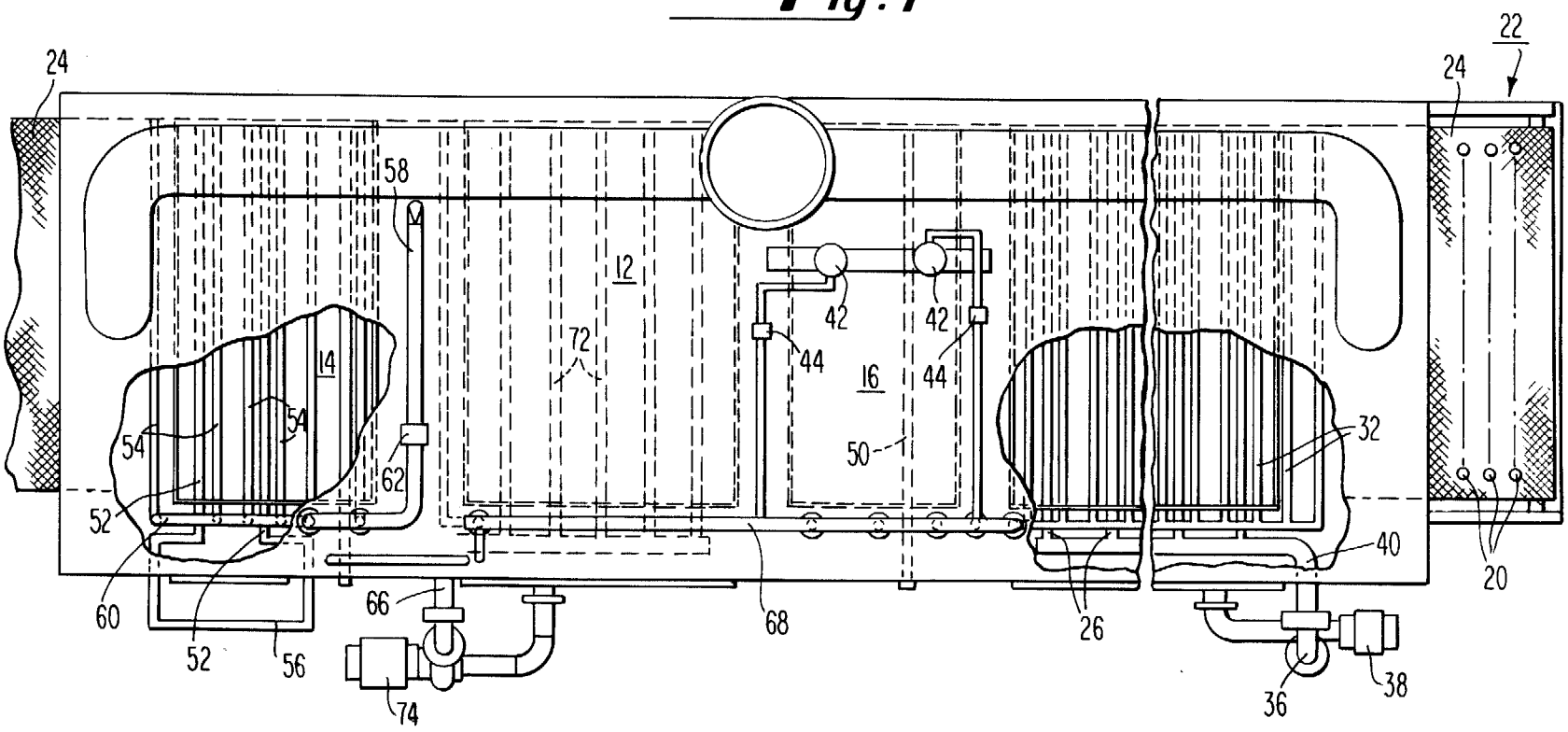
FIG. 1 is a semischematic plan view of a washing system embodying this invention.
Figure 2:
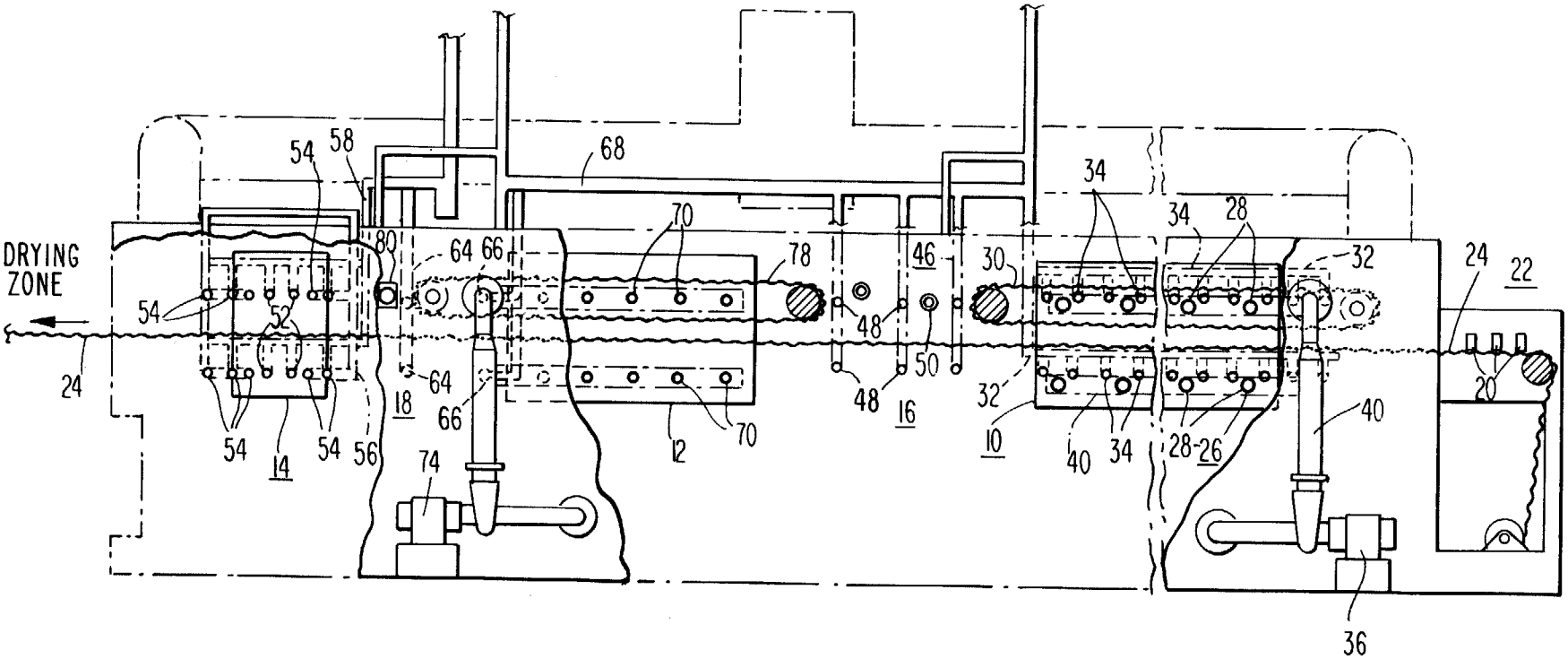
FIG. 2 is a semischematic side view of a washing system embodying this invention.

The washing system of this invention is divided into an alkaline washing zone 10, a rinsing zone 12 and a deionized rinsing zone 14 and a drying zone not shown. A steam blow-off area 16 is positioned between the washing zone 10 and the rinsing zone 12 and a similar steam blow-off area 18 is located between the rinsing zone 12 and the deionized rinsing zone 14. Inverted containers in the form of cans 20 enter the washer system in a can infeed area 22 and are conveyed through the washer system on a conveyor 24.

The alkaline washing zone 10 comprises a manifold 26 having a plurality of spray nozzles 28 located above and below the path of the upright cans 20 on the liquid pervious conveyor 24. Spray nozzles 28 direct the alkaline wash liquid downwardly and upwardly toward the cans 20 to remove foreign matter such as drawing lubricant from the cans. A hold-down conveyor 30 located above the cans 20, contacts the uppermost portion of the cans while the lowermost portion rides on the conveyor 24 so as to assure that the cans are not upset as they pass through the alkaline washing zone. Both the conveyor 24 and the conveyor 30 are pervious to the water from the spray nozzles 28.

In accordance with this invention, the alkaline wash zone 10 comprises a fogging manifold 32 having a plurality of fogging nozzles 34 positioned above and below the cans 20. The fogging nozzles 34 atomize a suitable liquid, e.g., water, when the conveyor 24 and the conveyor 30 stop and the spray from the nozzles 28 is interrupted so as to assure that the cans 20 remain in the moist condition so as to prevent oxidation or rusting thereof. Of course, interruption of the alkaline wash liquid spray from the nozzles 28 is important to eliminate the etching (detinning of tinplated cans) when the conveyors 24 and 30 stop.

The alkaline wash liquid, which may comprise a mild alkaline biodegradable detergent such as Pennwalt 110-C is pumped through the nozzles 28 by a pump 36 coupled to the manifold 26 through a pipe 40. The spray of the alkaline wash liquid from the nozzles 26 may be interrupted by turning off the pump 36.

In accordance with another important aspect of this invention, the fogging manifold 32 and the fogging nozzles 34 are connected to a source of heated water comprising heaters 42 which heat the liquid to be atomized to a temperature substantially equal to the alkaline wash liquid which is sprayed from the nozzles 26. The control of atomization of the liquid from the nozzles 34 is achieved by solenoid activated valves 44 which are responsive to stoppage of the conveyors 24 and 30 and the interruption of the alkaline wash liquid spray from the nozzles 28. Of course, these same valves are closed automatically when the conveyors 24 and 30 are started up again and the alkaline wash liquid is again directed at the cans 20 from the spray nozzles 28. The heating of the liquid to be atomized from the fogging nozzles 34 is necessary so as to prevent descaling within the alkaline washer manifold 26 which could clog the nozzles 28.

In further accordance with this invention, the steam blow-off area 16 comprises a fogging manifold 46 including a plurality of fogging nozzles 48 located above and below the conveyor 24. The nozzles 48 are located ahead and behind the steam blow-off jets 50.

In still further accordance with this invention, both deionized rinsing liquid spray nozzles 52 and fogging nozzles 54 are provided in the deionized rinsing zone 14. The spray nozzles 52 are connected to a source of deionized rinsing liquid, e.g., water absent any calcium, magnesium and iron which flows through a manifold 56. The fogging nozzles 54 are connected to a deionized cold water infeed 58 through a manifold 60. The control of the atomizing through the fogging nozzles 54 is achieved by a solenoid valve 62 in the fogging cold water infeed line 58.

Steam blow-off area 18 including steam jets 80 also includes fogging nozzles 64 and 66. Fogging nozzles 64 are connected to the source of fogging liquid through line 58 and therefore are under the control of the solenoid valve 62. Fogging nozzles 66 are connected to the heaters 42 through a line 68 and therefore are under the control of the solenoids 44. The heating of the atomized liquid from the nozzles 66 is necessary since these nozzles are located adjacent spray nozzles 70 in the rinsing zone 12 and cold water from the fogging cold water infeed line 58 could create descaling in the manifold 72 which delivers the rinsing liquid through the nozzles 70 from a pump 74. Note that the rinsing zone also includes an upper conveyor 78 which contacts the uppermost portion of the cans 20 to maintain them in the upright position as they pass between the rinsing spray nozzles 70. It will be noted that there are no fogging nozzles located in the rinsing zone. Fogging nozzles are not necessary in the rinsing zone as long as the liquid which is being directed at the cans 20 will not produce an etching or detinning effect.

The liquid which is atomized to produce the fog in the wash zone 10, the deionized rinse zone 12, and the steam blow-off areas 16 and 18 may comprise readily available water, e.g., industrial or city water. As mentioned previously, it is preferably heated to substantially the same temperature as the liquid in the zone 10 and the rinse zone 12. Specifically, this temperature is in the range of 70°–85° F. as contrasted with a washing temperature, for example, of 140°–160° F.

The terms fogging and atomizing have been utilized herein and contrasted with the term spraying. In terms of this invention, the fogging or atomizing is intended to mean the creation of a mist which is relatively fine as compared with the liquid which is sprayed from the nozzles in the wash zone, the rinse zone and the deionized rinse zone.

Although not shown or described, the cans 20 leaving the deionized rinsing zone 14 typically enter a drying zone. Once the cans have been dried, they pass to the next manufacturing phase of the line. Typically, the next phase will involve the coating of the can on the exterior thereof with subsequent lithography and interior spraying. This is particularly true with the can 20 of the D&I (drawn and ironed) type which comprises steel in the form of tinplate or "black plate".

Although the details of certain aspects of the washer system have not been described as shown, it will be understood that these details are well known in the art. For example, the control means for activating and deactivating the atomizing nozzles in response to conveyor stoppage are well known to those of ordinary skill in the art. It should be noted that washers containing some of the features more or less unrelated to the aspects of the invention are presently manufactured by the Metal Wash Machinery Corporation of Elizabeth, N.J.

It will also be understood that various modifications may be made in the preferred embodiment of the invention without departing from the true spirit and scope of the invention as set forth in the appended claims. For example, it is possible to substitute the washing and rinsing solutions disclosed herein for other liquids some of which may be equally damaging to the cans 20 if they were to be directed at the cans while the cans remained stationary within the washer system.

What is claimed is:

1. Apparatus for cleaning containers in substantial quantities comprising:

a housing having a plurality of cleaning zones;

means for conveying containers through said plurality of cleaning zones;

means for directing a spray of cleaning liquid toward said containers within at least one of said cleaning zones;

means for atomizing a fogging liquid into at least one of said zones so that the mist of atomized liquid is fine relative to the spray of the cleaning liquid; and control means for interrupting said means for directing a spray of cleaning liquid toward said containers in at least one of said zones when said conveying means is interrupted while said fogging liquid is atomized into at least one of said zones so as to substantially reduce the oxidation of said containers when the spray of cleaning liquid in at least one of said zones is interrupted.

2. The apparatus of claim 1 wherein one of said cleaning zones comprises a washing zone and said means for directing a spray of liquid toward said containers comprises a plurality of washing nozzles extending along said conveying means within said washing zone for directing a washing liquid toward said containers, said atomizing means comprising a plurality of atomizing nozzles also extending along said conveying means within said washing zone.

3. The apparatus of claim 2 wherein another of said plurality of zones comprises a rinsing zone with the means for directing cleaning liquid toward said containers comprising rinsing nozzles extending along said conveying means within said rinsing zone, said atomizing means including a plurality of atomizing nozzles located between said washing and said rinsing zone along said conveying means.

4. The apparatus of claim 1 further comprising a deionized rinsing zone, said means for directing a spray of liquid toward said containers comprising a plurality of deionized rinse nozzles for directing a deionized rinsing liquid toward said containers.

5. The apparatus of claim 4 wherein said atomizing means further comprises atomizing nozzles in said deionized rinsing zone extending along said conveying means.

6. The apparatus of claim 1 wherein said zones include a washing zone, a rinsing zone and a deionized rinsing zone, said washing zone and said rinsing zone being separated by a first blow-off area and said rinsing zone and said deionized rinsing zone being separated by a second blow-off area, and atomizing means including a plurality of atomizing nozzles in said blow-off areas.

7. The apparatus of claim 6 wherein said atomizing means includes a plurality of atomizing nozzles in said washing zone and said deionized rinsing zone.

8. The apparatus of claim 7 further wherein said control means activates said atomizing means in response to stoppage of said conveying means.

9. The apparatus of claim 8 wherein said means for directing a spray of cleaning liquid comprises a plurality of washing nozzles in said washing zone, a plurality of rinsing nozzles in said rinsing zone and a plurality of deionized rinsing nozzles in said deionized rinsing zone.

10. The apparatus of claim 7 further comprising means for heating a liquid atomized by said atomizing means.

11. A method of cleaning containers in substantial quantities comprising the following steps:

conveying said containers through a washing zone and a rinsing zone;

spraying said containers with a washing liquid and a rinsing liquid while said containers are conveyed through said washing zone and said rinsing zone;

interrupting the spraying of said containers within said washing zone and the conveyance of said containers through said washing zone; and creating a fog in said washing zone while said containers are relatively stationary within said washing zone when the spraying of said containers within said washing zone is interrupted so as to substantially retard the oxidation of said containers, the droplets of said fog being fine relative to the droplets of said washing liquid.

12. The method of claim 11 wherein said washing liquid comprises an alkaline liquid.

13. The method of claim 11 further comprising the steps of conveying said containers through a deionized rinsing zone and spraying said containers with a deionized rinsing liquid.

14. The method of claim 13 further comprising the steps of interrupting the spraying of said containers with said deionized rinsing liquid and creating a fog in said deionized rinsing zone while said containers are relatively stationary within said deionized rinsing zone so as to substantially retard the oxidation of said containers.

15. The method of claim 14 including the steps of blowing said washing liquid and said rinsing liquid off said containers between said washing zone and said rinsing zone and between said rinsing zone and said deionized rinsing zone.

16. The method of claim 15 including the steps of interrupting the blowing of said washing liquid and said rinsing liquid off said containers and creating a fog between said washing zone and said rinsing zone and a fog between said rinsing zone and said deionized rinsing zone during the interruption in the blowing.

17. The method of claim 16 wherein the fog in said washing zone is formed by atomizing a preheated liquid maintained at a temperature substantially equal to the temperature of the washing liquid.

* * * * *